US005969741A

United States Patent [19]

Appel et al.

[11] Patent Number: 5,969,741

[45] Date of Patent: Oct. 19, 1999

[54] RASTER SCANNER WITH A SELECTABLE SPOT DIMENSION

[75] Inventors: James J. Appel, Rochester; John R. Andrews, Fairport, both of N.Y.

[73] Assignee: Xerox Corporation, Stamford, Conn.

[21] Appl. No.: 08/664,749

[22] Filed: Jun. 17, 1996

[51] Int. Cl.[6] ..... B41J 2/385; B41J 2/47

[52] U.S. Cl. ..... 347/136; 347/239; 347/255

[58] Field of Search ..... 347/256, 239, 347/255, 134, 136

[56] References Cited

U.S. PATENT DOCUMENTS

| | | | |
|---|---|---|---|
| 4,874,664 | 10/1989 | Hamaguchi et al. | 428/325 |
| 5,272,715 | 12/1993 | Guerin | 372/98 |
| 5,363,128 | 11/1994 | Andrews | 346/108 |
| 5,438,354 | 8/1995 | Genovese | 347/256 |
| 5,469,290 | 11/1995 | Maeda | 359/210 |
| 5,479,011 | 12/1995 | Rudeen et al. | 250/235 |
| 5,493,326 | 2/1996 | Andrews et al. | 347/257 |
| 5,510,826 | 4/1996 | Koide | 347/256 |
| 5,521,748 | 5/1996 | Sarraf | 359/321 |
| 5,663,826 | 9/1997 | Tsuda et al. | 359/202 |
| 5,668,590 | 9/1997 | Maruo et al. | 347/256 |

OTHER PUBLICATIONS

Electro–Optical Devices and System by Mohammad A. Karim, Ph.D., PWS–Kent Publishing Co., pp. 278–303, 1990.

*Primary Examiner*—Safet Metjahic
*Assistant Examiner*—Christopher Mahoney
*Attorney, Agent, or Firm*—John M Kelly

[57] ABSTRACT

Raster scanner assemblies, and machines which use such raster scanner assemblies, which produce spots having a variable spot dimension. Raster scanner assemblies according to the present invention include an electronic subsystem which produces both image data and a spot size control signal, a laser assembly which produces a polarized laser beam having a beam with a first dimension and which is modulated in accord with the image data, a variable aperture assembly which changes the first dimension of the laser beam, a rotating polygon having a plurality of facets sweeping the laser beam in a sweep plane, and a scan lens for focusing the laser beam onto an image plane. The variable aperture assembly beneficially includes both a liquid crystal cell, which receives the laser beam and the spot size control signal, and a polarizing filter. The liquid crystal cell changes the polarization of part of the laser beam in response to the spot size control signal, while the polarizing filter passes the laser beam as a function of the beam's polarization. Beneficially, the liquid crystal cell is a twisted nematic liquid crystal cell. Preferably, the first dimension is in the cross-scan direction.

8 Claims, 4 Drawing Sheets

RASTER SCANNER WITH A SELECTABLE SPOT DIMENSION

FIELD OF THE INVENTION

This invention relates to electrophotographic systems which use raster scanners. More specifically, it relates to electrophotographic systems with raster scanners which image variable sized spots.

BACKGROUND OF THE INVENTION

Electrophotographic marking is a well known method of copying or printing documents or other substrates. Electrophotographic marking is typically performed by exposing a light image of an original document onto a substantially uniformly charged photoreceptor. That light image discharges the photoreceptor so as to create an electrostatic latent image of the original on the photoreceptor's surface. Toner particles are then deposited onto the latent image so as to form a toner image. That toner image is then transferred from the photoreceptor, either directly or after an intermediate transfer step, onto a marking substrate such as a sheet of paper. The transferred toner powder image is then fused to the marking substrate using heat and/or pressure. The surface of the photoreceptor is then cleaned of residual developing material and recharged in preparation for the creation of another image.

While many types of light exposure systems have been developed, a commonly used system is the raster output scanner (ROS). A raster output scanner is comprised of a laser beam source, a modulator for modulating the laser beam (which, as in the case of a laser diode, may be the source itself) such that the laser beam contains image information, a rotating polygon having at least one reflective surface, input optics that collimate the laser beam, and output optics which focus the laser beam into a spot on the photoreceptor and which correct for various optical problems such as wobble. The laser source, modulator, and input optics produce a collimated laser beam which is directed toward the polygon. As the polygon rotates the reflective surface(s) causes the laser beam to be swept along a scan plane. The swept laser beam passes through the output optics and is reflected by the mirror(s) so as to produce a sweeping spot on a charged photoreceptor. The sweeping spot traces a scan line across the photoreceptor. Since the charged photoreceptor moves in a direction which is substantially perpendicular to the scan line, the sweeping spot raster scans the photoreceptor. By suitably modulating the laser beam a desired latent image can be produced on the photoreceptor.

To assist the understanding of the present invention several things should be further described and highlighted. First, most prior art electrophotographic printing machines are single resolution devices; that is, they produce an image at N number of spots per inch in the cross-scan direction (the direction which the photoreceptor moves), where N is typically 300, 600 or 800. But whatever N is, it is fixed. While single resolution printing machines are relatively straightforward, they may not be optimal. For example, when printing a bit-map which represents an image of M spots per inch on a prior art machine which has a resolution of N spots per inch, where M is not equal to N, software resolution conversion is required before printing. Not only does such software conversion require significant time and computer resources, but bit round-off errors frequently occur. Therefore, an electrophotographic printing machine having variable resolution would be advantageous.

When attempting to implement a variable resolution electrophotographic printing machine it quickly becomes obvious that one approach to achieving variable resolution is to change the size of the spot produced on the photoreceptor by the laser beam. Changing the dimension of the spot in the fast scan direction is relatively easy. In a machine with a fixed scan rate the laser spot images an area having length which is predominately controlled by the time duration that the laser is turned on. To write at a lower resolution the laser can be turned on for longer periods of time. However, since the cross-scan dimension of the image area illuminated by the spot is controlled by the cross-scan dimension of the spot, controlling the resolution in the cross-scan dimension is much more difficult. Even in the fast scan direction is may be beneficial to be able to electronically control the length of the spot without changing the laser on time. Therefore, a technique of controlling the dimensions of the spot on the photoreceptor would be advantageous.

SUMMARY OF THE INVENTION

The principles of the present invention provide for controlling a dimension of a spot produced by a laser beam on a photoreceptor or other surface. A raster scanner assembly according to the present invention is comprised of an electronic subsystem, which produces both image data and a spot size control signal, and a laser assembly which generates a laser beam having a first dimension and which is modulated in accord with the image data. The raster scanner assembly further includes a variable aperture assembly which receives the modulated laser beam from the laser assembly, which changes the first dimension of the laser beam in accord with the spot size control signal, and which passes the laser beam to a rotating polygon having a plurality of facets. The rotating polygon sweeps the laser beam in a sweep plane where the sweeping laser beam passes through a scan lens which focuses the swept laser beam onto an image plane. Beneficially, the variable aperture assembly includes both a liquid crystal cell, which receives the laser beam and the spot size control signal, and a polarizing filter. The liquid crystal cell changes the polarization of part of the laser beam in response to the spot size control signal, while the polarizing filter passes the laser beam as a function of the beam's polarization. Preferably the liquid crystal cell is a twisted nematic liquid crystal cell

BRIEF DESCRIPTION OF THE DRAWINGS

Other aspects of the present invention will become apparent as the following description proceeds and upon reference to the drawings, in which.

DETAILED DESCRIPTION OF THE PREFERRED EMBODIMENTS

Figure 1:
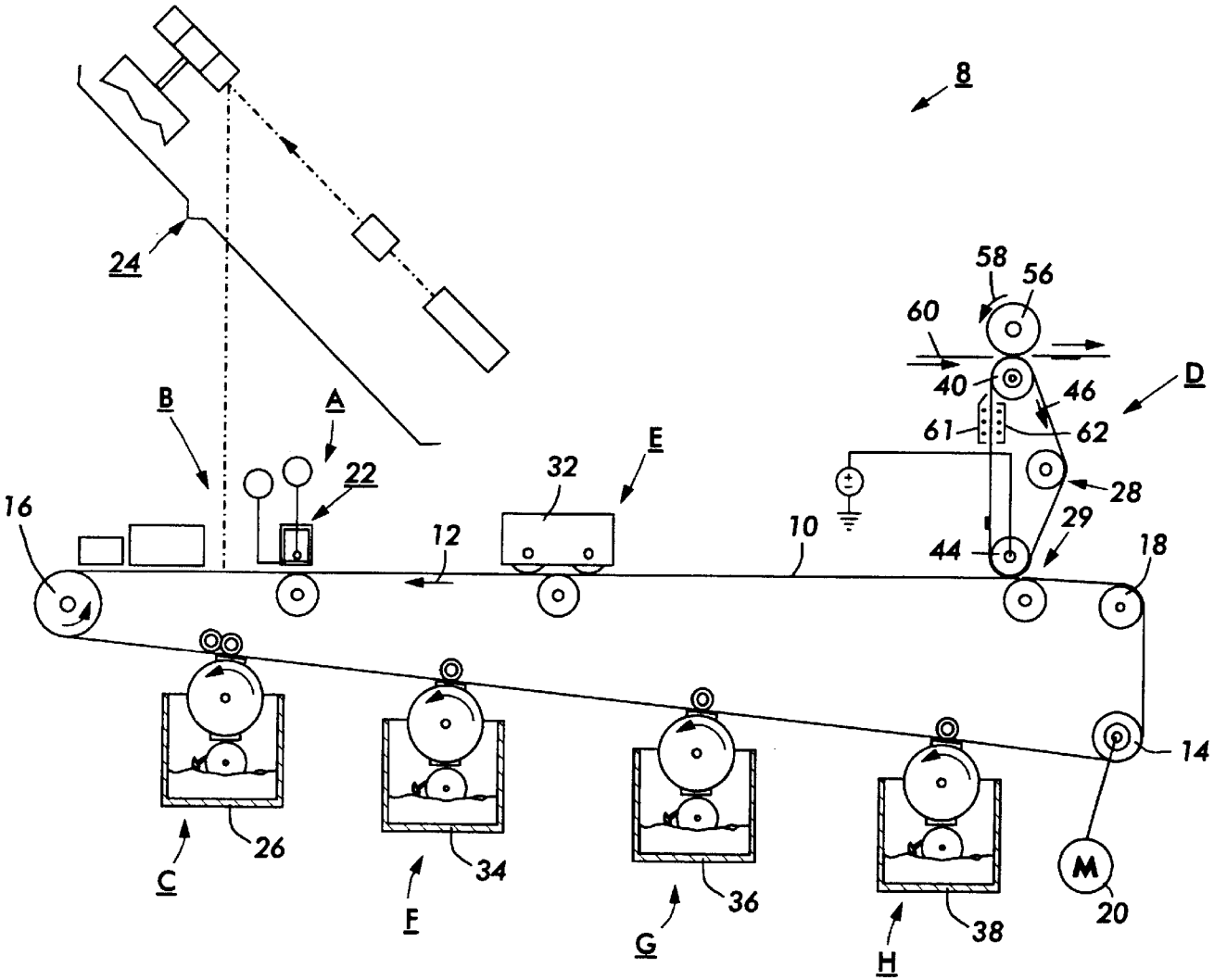
FIG. 1 schematically illustrates an electrophotographic printing machine which incorporates the principles of the present invention.

FIG. 1 illustrates an electrophotographic printing machine 8 that produces an original document. Although the principles of the present invention are well suited for use in such machines, they are also well suited for use in other printing devices. Therefore it should be understood that the present invention is not limited to the particular embodiment illustrated in FIG. 1 or to the particular application shown therein.

The printing machine 8 includes a charge retentive device in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each part of it passes through each of the subsequently described processing stations. For convenience, a single section of the photoreceptor, referred to as the image area, is identified. The image area is that part of the photoreceptor which is operated on by the various stations to produce toner layers. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

Figure 2:
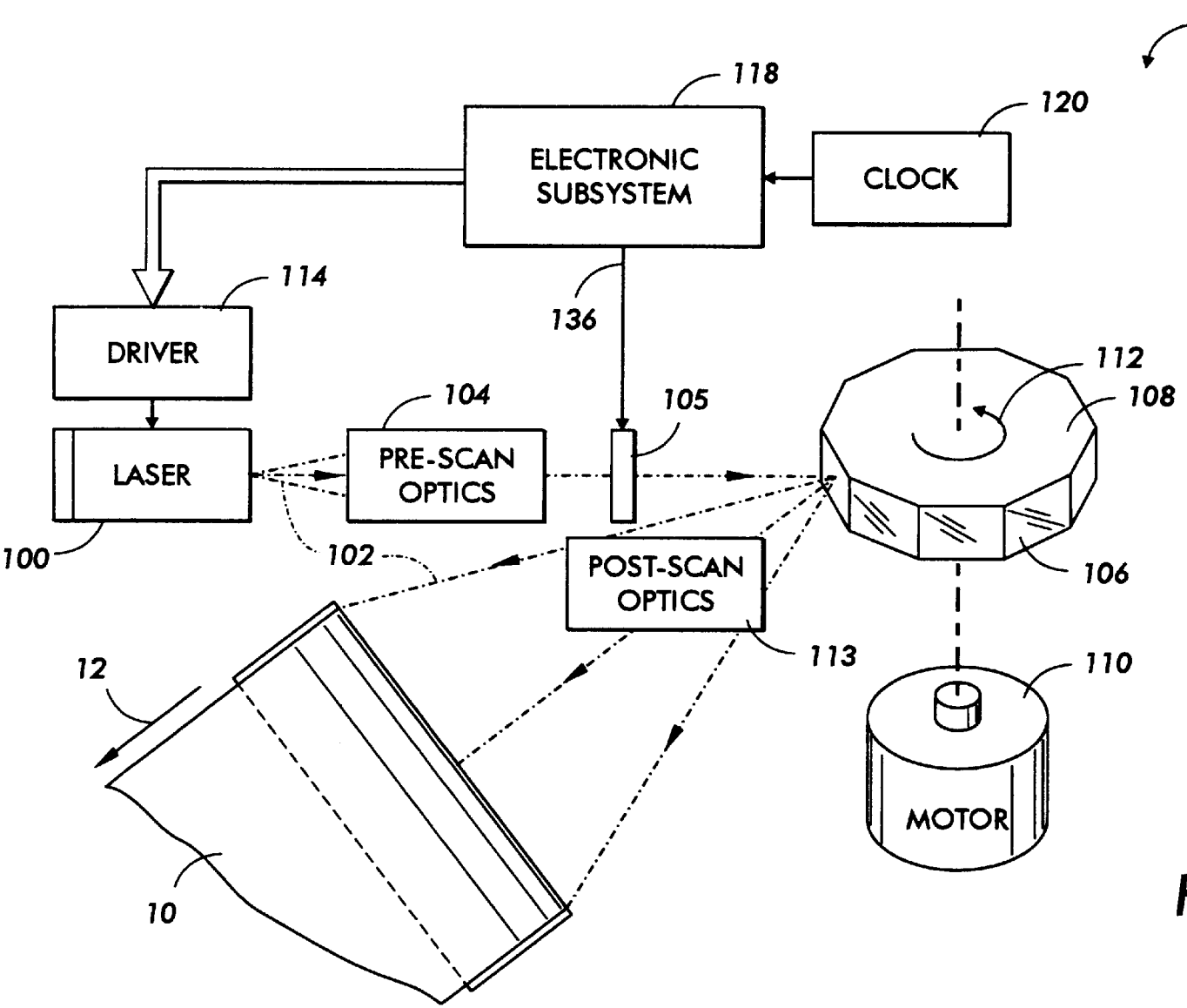
FIG. 2 is a schematic depiction of an exposure station which is in accord with the principles of the present invention.

After passing through the charging station A the now charged image area passes to an exposure station B. At exposure station B the charged image area is exposed to the output of a laser based raster output scanning assembly 24 which illuminates the image area with a light representation of a first color image, say black. That light representation discharges some parts of the image area so as to create a first electrostatic latent image. Since the principles of the present invention specifically relate to the Exposure station B, the raster output scanning assembly 24 assembly, which is schematically depicted in FIG. 2, is described in more detail subsequently. After passing through the exposure station B, the now exposed image area passes through a first development station C. At the first development station C a negatively charged development material 26, which is comprised of black toner particles, is advanced to the image area. The development material is attracted to the less negative sections of the image area and repelled by the more negative sections. The result is a first toner layer on the image area.

After passing through the first development station C the image area is advanced to a transfusing module D. That transfusing module includes a positively charged transfusing member 28, which may be a belt, as illustrated in FIG. 1, or a drum which forms a first nip 29 with the photoreceptor. That nip is characterized by a first pressure between the photoreceptor 10 and the transfusing member 28. The negatively charged toner layer on the photoreceptor is attracted onto the positively charged transfusing member.

After the first toner image is transferred to the transfusing member 28 the image area passes to a cleaning station E. The cleaning station E removes any residual development material remaining on the photoreceptor 10 using a cleaning brush contained in a housing 32.

After passing through the cleaning station E the image area repeats the charge-expose-develop-transfer-clean sequence for a second color of developer material (say yellow). Charging station A recharges the image area and exposure station B illuminates the recharged image area with a light representation of a second color image (yellow) to create a second electrostatic latent image. The image area then advances to a second development station F which deposits a second negatively charged development material 34, which is comprised of yellow toner particles, onto the image area so as to create a second toner layer. The image area and its second toner layer then advances to the transfusing module D where the second toner layer is transferred onto the transfusing member 28.

The image area is again cleaned by the cleaning station E. The charge-expose-develop-transfer-clean sequence is then repeated for a third color (say magenta) of development material 36 using development station G, and then for a fourth color 38 (cyan) of development material using development station H.

Turning our attention to the transfusing module D, the transfusing member 28 is entrained between a transfuse roller 40 and a transfer roller 44. The transfuse roller is rotated by a motor, which is not shown, such that the transfusing member rotates in the direction 46 in synchronism with the motion of the photoreceptor 10. The synchronism is such that the various toner images are registered after they are transferred onto the transfusing member 28.

Still referring to FIG. 1, the transfusing module D also includes a backup roller 56 which rotates in the direction 58. The backup roller is beneficially located opposite the transfuse roller 40. The backup roller cooperates with the transfuse roller to form a second nip which acts as a transfusing zone. When a substrate 60 passes through the transfusing zone the toner layer on the compression layer is heated by a combination of heat from a radiant preheater 61 or from conductive heat from a conductive heater 62 and heat from the transfuse roller 40. The combination of heat and pressure fuses the composite toner layer onto the substrate.

As mentioned above, the raster output scanning assembly 24 is shown in more detail in FIG. 2. The raster output scanning assembly includes a laser diode 100 which emits a polarized laser beam 102 into a set of pre-scan optics 104. The pre-scan optics 104 collimates the laser beam and directs the collimated laser beam into a variable aperture assembly 105 which, as is discussed below, controls the cross-scan spot size. The laser beam from the variable aperture assembly is directed onto facets 106 of a polygon 108 which is rotated by a polygon motor 110 in a direction 112. The laser beam 102 reflects from the rotating facets as a sweeping laser beam. The sweeping laser beam passes through a set of post-scan optics 113 which both focuses the sweeping beam into a spot on the photoreceptor 10 (see FIG. 1) and which corrects for various optical errors (such as wobble).

The laser diode 100 is modulated by drive current from a driver 114, which applies drive currents to the laser in response to electronic drive signals from an electronic subsystem 118. The electronic subsystem could be a computer, a facsimile machine, a raster input scanner, or some other source of image data. The image data is applied to the driver 114 in synchronism with clock signals from a clock 120. To adjust the printer resolution in the fast scan direction the image data could be clocked faster or slower so as to cause the driver to apply drive current to the laser such that the image data represents a different printer resolution.

However, control of the cross-scan spot size is by way of the variable aperture assembly 105.

Figure 3:
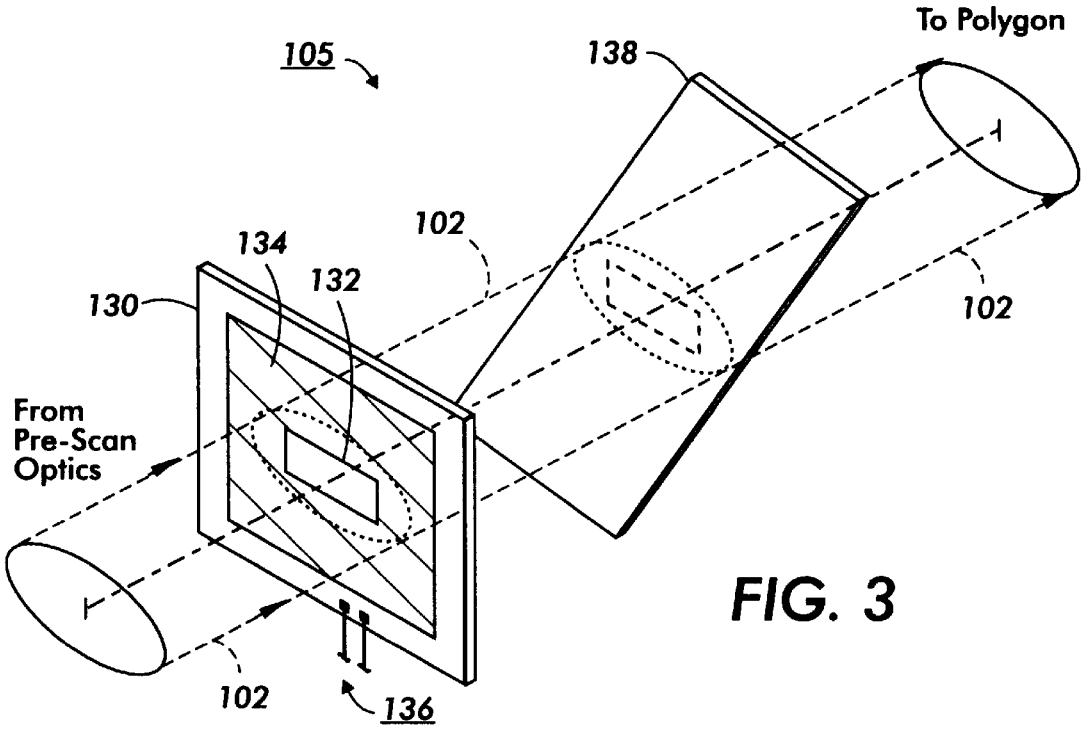
FIG. 3 is a schematic depiction of a variable aperture assembly in which the polarization electrodes are not energized.

The variable aperture assembly 105 is shown in FIG. 3. As shown, the collimated, polarized light beam 102 from the pre-scan optics 104 is input to a liquid crystal cell 130 which is not energized. For simplicity, the liquid crystal cell 130 is preferably a twisted nematic liquid crystal cell. However, other types of liquid crystal cells, including ferro-electric and variable bi-refringence liquid crystal cells can also be used. The liquid crystal cell 130 is comprised of an inner section 132, which can either be devoid of liquid crystal material or filled with liquid crystal material, and an outer section 134 which is filled with liquid crystal material. Electrodes (which are not shown in FIG. 3 for clarity, but see FIG. 5 for similar electrodes) are disposed adjacent to the outer section such that electrically activated polarization switching of the twisted nematic effect (or ferro-electric or bi-refringence or other effect, depending on the particular implementation of the liquid crystal cell 130) occurs in the outer section 134 when a spot size control signal is energizes input lines 136. If the inner section 132 is filled with a liquid crystal material care must be taken to ensure that the inner section is not electrically activated. The input lines connect to the electronic subsystem 118, see FIG. 1. The variable aperture assembly 105 also includes a polarizer 138 which has a polarization axis aligned with the polarized laser beam 102.

Several aspects of the design of the raster output scanning assembly 24 should be noted. First, the laser beam 102 which images the variable aperture assembly 105 should have a dimension which is larger than the inner section 132. Second, the raster output scanning assembly should be designed such that the diffraction limiting performance of the optical components is not exceeded when imaging the smallest spot produced on the photoreceptor. Third, all of the optical components should be designed to handle the smallest spot produced by the system.

During the operation of the raster output scanning assembly, when imaging using a spot with a small cross-scan dimension the electronic subsystem 118 does not apply a spot size control signal to the lines 136. The liquid crystal material in the outer section 134 then readily passes the polarized laser beam 102 to the polarizer 138. As the polarizer has a polarization axis which is aligned with the polarization of the laser beam 102 the laser beam passes though the polarizer with only nominal attenuation which is uniform across the entire beam.

Figure 4:
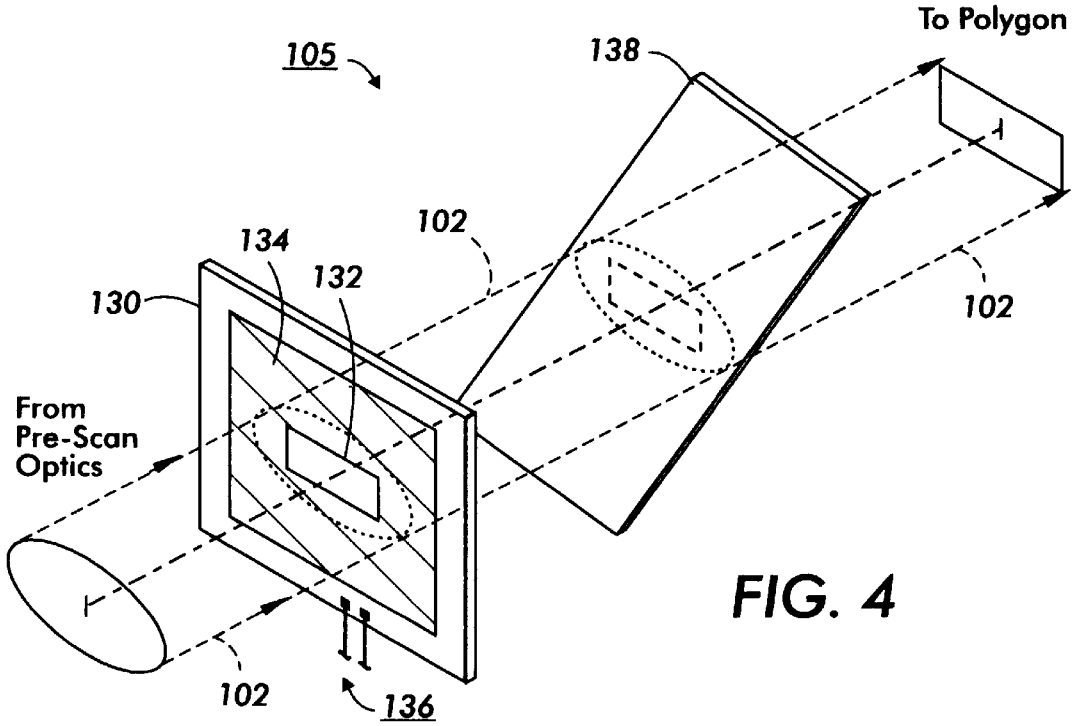
FIG. 4 is a schematic depiction of a variable aperture assembly in which the polarization electrodes are energized.

Referring now to FIG. 4, when imaging with a spot having a large cross-scan dimension the electronic subsystem 118 applies a spot size control signal to the lines 136. With the spot size control signal present the liquid crystal material in the outer section 134 shifts the axis of polarization of the part of the laser beam 102 which passes through the outer section by an angle of 90°. However, the polarization of the part of the laser beam which passes through the inner section 132 is not shifted in polarization. When the laser beam 102 reaches the polarizer 138, the polarizer blocks the polarization rotated part of the beam, but passes with only nominal attenuation the part which passed through the inner section. Therefore, the spot size control signal from the electronic subsystem controls the cross-scan spot size.

Figure 5:
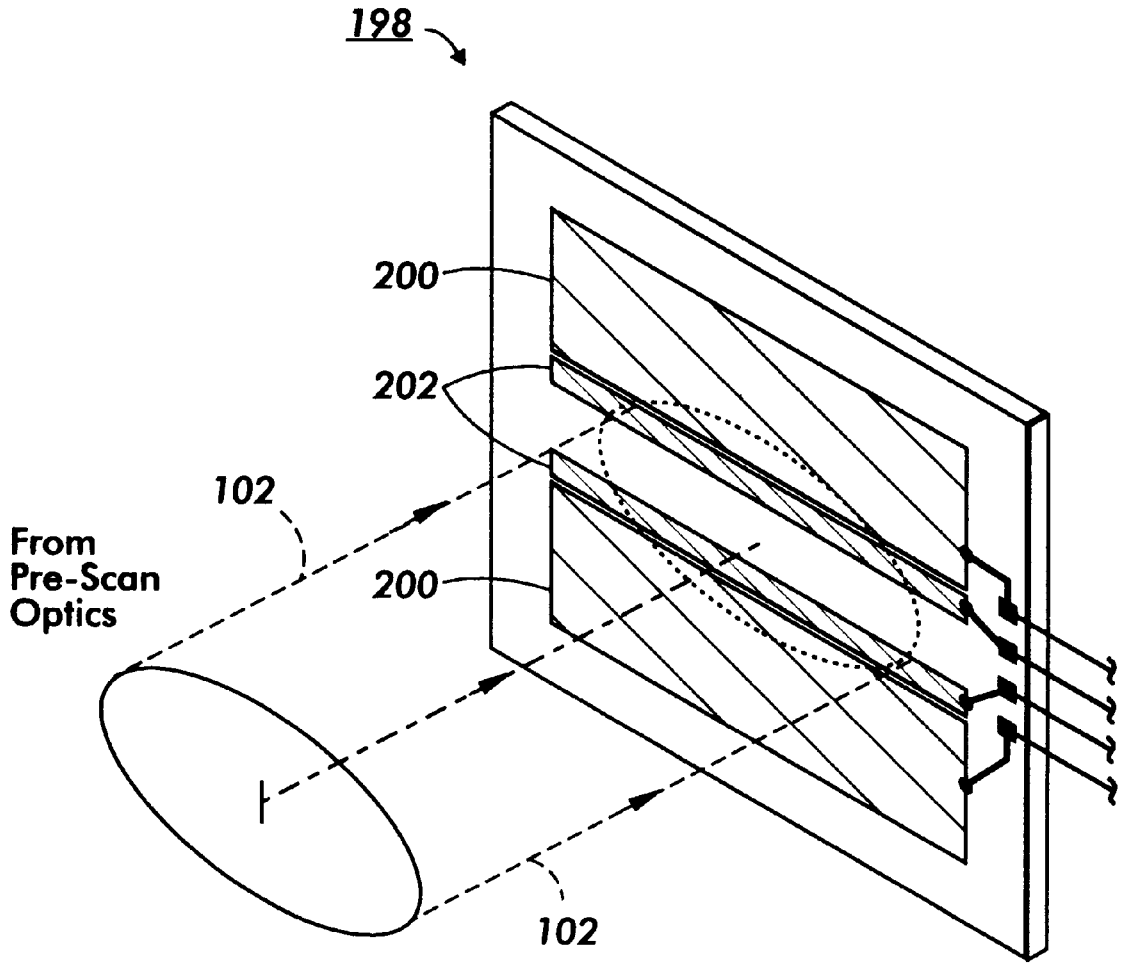
FIG. 5 is a schematic depiction of a variable aperture assembly that is capable of imaging using multiple spot dimensions.

While the foregoing describes an electrophotographic system capable of imaging using spots having two different cross-scan dimensions, it should be clearly understood that the principles of the present invention can be used to image spots of numerous sizes. For example, FIG. 5 shows a variable aperture assembly 198 having multiple pairs of electrodes, the electrode pairs 200 and 202, which are arranged such that they influence different sections of the laser beam. As shown, the variable aperture assembly 198 controls the fast scan (tangential) dimension of the spot. Then, by selectively energizing the individual electrode pairs the electronic subsystem can shift the polarization of different sections of the laser beam so as to image spots having any of three sizes (after passing through the polarizer). To activate the largest tangential spot size, none of the electrode pairs are energized. To activate a smaller size spot the electronic subsystem can energize electrode pair 200. To activate the smallest size spot the electronic subsystem can activate both of the electrode pairs.

One way of using the variable aperture assembly 198 shown in FIG. 5 would be to print different fast scan resolutions. For example, the electrode pairs could be arranged such that the smallest size spot is suitable for printing at 600 spots per inch, the smaller size spot is suitable for printing at 400 spots per inch, and the largest size spot is suitable for printing at 300 spots per inch.

Furthermore, the principles of the present invention can also be used to control both the cross-scan and the fast scan dimensions.

Therefore, it is to be understood that while the figures and the above description illustrate the present invention, they are exemplary only. Others who are skilled in the applicable arts will recognize numerous modifications and adaptations of the illustrated embodiments which will remain within the principles of the present invention. Thus the present invention is to be limited only by the appended claims.

What is claimed:

1. A raster scanner assembly comprised of:

an electronic subsystem for producing both image data and a spot size control signal;

a laser assembly for generating a polarized laser beam having a first beam dimension, wherein said polarized laser beam is modulated in accord with said image data;

a variable aperture assembly operatively connected to said electronic subsystem and receiving said laser beam from said laser assembly, said variable aperture assembly for changing said first dimension of said laser beam in accord with said spot size control signal;

a rotating polygon having a plurality of facets receiving the spot size controlled laser beam from said variable aperture assembly, said rotating polygon for sweeping said spot size controlled laser beam in a sweep plane; and a scan lens receiving said spot size controlled laser beam from said rotating polygon, said scan lens for focusing said spot size controlled laser beam onto an image plane.

2. The raster scanner assembly according to claim 1, wherein said variable aperture assembly is comprised of a liquid crystal cell which receives said laser beam from said laser assembly and which receives said spot size control signal, said variable aperture assembly further comprised of a polarizing filter, wherein said liquid crystal cell changes the polarization of part of said laser beam from said laser assembly in response to said spot size control signal, and wherein said polarizing filter passes said laser beam as a function of the laser beam's polarization.

3. The raster scanner assembly according to claim 2, wherein said liquid crystal cell is comprised of a twisted nematic liquid crystal cell.

4. The raster scanner assembly according to claim 1, wherein said first dimension is in a cross-scan direction.

5. A marking machine comprised of:

a photoreceptor having a photoconductive surface which moves in a cross-scan direction;

a charging station for charging said photoconductive surface to a predetermined potential;

a raster scanner assembly for exposing said photoconductive surface to produce a first electrostatic latent images on said photoconductive surface by sweeping a modulated laser beam across said photoreceptor in a fast scan direction which is substantially perpendicular to said cross-scan direction;

a first developing station for depositing developing material on said first electrostatic latent image so as to produce a first toner image on said photoconductive surface; and a transfer station for receiving said first toner image from said photoconductive surface and for transferring said first toner image onto a substrate;

wherein said raster scanner assembly includes:

an electronic subsystem for producing both image data and a spot size control signal;

a laser assembly for generating a polarized laser beam having a first beam dimension, wherein said polarized laser beam is modulated in accord with said image data;

a variable aperture assembly operatively connected to said electronic subsystem and receiving said laser beam from said laser assembly, said variable aperture assembly for changing said first dimension of said laser beam in accord with said spot size control signal;

a rotating polygon having a plurality of facets receiving the spot size controlled laser beam from said variable aperture assembly, said rotating polygon for sweeping said spot size controlled laser beam in a sweep plane; and a scan lens receiving said laser beam from said rotating polygon, said scan lens for focusing said spot size controlled laser beam onto said photoconductive surface.

6. The raster scanner assembly according to claim 5, wherein said variable aperture assembly is comprised of a liquid crystal cell which receives said laser beam from said laser assembly and which receives said spot size control signal, said variable aperture assembly further comprised of a polarizing filter, wherein said liquid crystal cell changes the polarization of part of said laser beam from said laser assembly in response to said spot size control signal, and wherein said polarizing filter passes said laser beam as a function of the laser beam's polarization.

7. The raster scanner assembly according to claim 6, wherein said liquid crystal cell is comprised of a twisted nematic liquid crystal cell.

8. The raster scanner assembly according to claim 5, wherein said first dimension is in a cross-scan direction.

* * * * *